US005778623A

United States Patent [19]

Powell

[11] Patent Number: 5,778,623

[45] Date of Patent: Jul. 14, 1998

[54] THREADED ROOF FASTENER AND METHOD FOR USING THE SAME

[75] Inventor: Kenneth S. Powell, Lilburn, Ga.

[73] Assignee: K & R Industries, Inc., Lawrenceville, Ga.

[21] Appl. No.: 794,179

[22] Filed: Feb. 3, 1997

[51] Int. Cl.[6] ..... E04B 5/00

[52] U.S. Cl. ..... 52/410; 411/531; 411/399

[58] Field of Search ..... 411/531, 395, 411/404, 403, 187, 188, 399; 52/410, 746.1, 512

[56] References Cited

U.S. PATENT DOCUMENTS

| | | |
|---|---|---|
| 3,289,290 | 12/1966 | Sandor . |
| 4,892,429 | 1/1990 | Giannuzzi . |
| 4,900,208 | 2/1990 | Kaiser et al. . |
| 5,069,589 | 12/1991 | Lemke . |
| 5,171,118 | 12/1992 | Rothenbuhler . |
| 5,217,339 | 6/1993 | O'Connor et al. . |
| 5,255,485 | 10/1993 | Lemke et al. . |
| 5,426,905 | 6/1995 | Rollhauser et al. . |
| 5,482,418 | 1/1996 | Giannuzzi . |

OTHER PUBLICATIONS

Brochure: FM–45 Fastener; ES Products, New Rochelle, NY.

Brochure: FM–30 Roofing Disk; ES Products, New Rochelle, NY.

Brochure: FM–90 Fastener; ES Products, New Rochelle, NY.

Brochure: FM–60 Fastener; ES Products, New Rochelle, NY.

*Primary Examiner*—Creighton Smith

*Attorney, Agent, or Firm*—Brooks & Kushman P.C.

[57] ABSTRACT

The present invention provides a roofing fastener, a roofing assembly including the roofing fastener, and a method of installing the roofing fastener into the roofing assembly. The roofing fastener includes a head and a shank integrally connected thereto. The shank and the thread thereon permits the roofing fastener to be self-tapping and threaded into a base substrate such as a concrete deck. Preferably, the roofing fastener includes a polygonal socket within nubbins thereon to squeeze about a drill bit. Also, ideally the head of the roofing fastener is round and has a diameter which is greater than the length of the shank. Ideally, the fastener is made of a low-moisture material which can absorb water from the surrounding substrate causing the fastener to swell and increase its holding power.

20 Claims, 1 Drawing Sheet

THREADED ROOF FASTENER AND METHOD FOR USING THE SAME

TECHNICAL FIELD

This invention relates to roofing fasteners for affixing roofing materials to roofs.

BACKGROUND OF THE INVENTION

Roofing components are applied to the top of roofs for several reasons. First, the roofing materials prevent moisture from reaching an underlying support member such as concrete or plywood. Also, roofing materials serve to insulate a building from the outdoors.

With respect to underlying support members which are made of lightweight deck concrete, such as concrete with a density of 200–220 lbs., and about two inches thick, a base ply sheet of felt-like material of fiberglass or organic material is commonly placed over the concrete. Roof fasteners are then installed through the base ply and into the lightweight concrete to hold the base ply to the support member. A layer of molten asphalt is then poured or brushed over the base ply and roofing fasteners. In some instances, a second layer of base ply sheets are placed over the first layer of asphalt while the asphalt is still hot. The asphalt thus holds the first and second layers of base ply sheet together.

In the event of high winds, it is important that the combination of the base ply sheet and asphalt be strongly anchored to the underlying roof substrate. With high winds, such as might accompany hurricanes, large relatively low pressure conditions can be created above the asphalt/base ply roofing materials. This wind or low pressure can rip the asphalt/base ply sheet roofing materials off the underlying roofing substrate if not sufficiently anchored.

A common type of roofing fastener used today to hold base ply and asphalt roof materials to a roofing substrate is a metallic stamped metal fastener having a generally flat head with spreadable legs. The fastener is pounded into the base ply and concrete substrate. The legs, generally originally parallel to one another, spread apart as they are driven into the substrate. Consequently, the fasteners cut their own inverted V-shaped hole into the substrate thus providing retainment.

These wedging fasteners have drawbacks. Often, the legs can bend if not properly installed. Also, these fasteners are made of a metal which is subject to corrosion which can lead their eventual failure. Further, these wedging fasteners have only a limited shear area engaging with the roofing substrate. Consequently, they have limited holding or tearing out strength relative to the substrate. Tear out strength test results conducted on these wedging fasteners installed in concrete substrates vary greatly from fastener to fastener due to inconsistency in their installation and tolerancing variations in the fasteners. Moreover, due to increasing losses in the insurance industry, pull out requirements for fasteners have been revised upward. Often these wedging fasteners fail to meet the new and higher industry standards. Typically, these wedging fasteners have a pull-out strength of about 100 lbs.

Problems exist with other fasteners as well. Multiple component fasteners are used which include a retaining disk with an aperture therethrough which receives a threaded fastener. This multiple piece construction increases the cost of making the fasteners and complexity of installation. These multiple component fasteners also have difficulty in meeting today's higher values.

The present invention is intended to address deficiencies found in these above-described conventional fasteners.

SUMMARY OF THE INVENTION

It is an object of the present invention to provide a roofing fastener having an integral head and threaded shank which provides greater wind uplift strength as compared to conventional roofing fasteners, preferably on the order of 250 lbs.

It is another object of the present invention to provide a roofing fastener with an enlarged head designed to provide an enlarged shear tear-out area as compared to conventional roofing fasteners, and which permits the tar to be spread over the base plies and the head of the fasteners, and penetrate through the head to contract the base ply therebeneath and thus more securely locking the base plies and fasteners together.

It is yet another object of the present invention to provide a roofing fastener with retaining nubs inside a polygonal opening to assist in holding the roofing fastener to a drill bit and to facilitate the drilling of the roofing fastener into a roofing substrate.

Still yet another object is to provide a roofing fastener with a threaded shank having a leading blade edge thereon to enhance the cutting of a hole in a roof substrate.

Another object is to provide a roofing fastener which will not allow roofing tar to penetrate through the fasteners to the underside of the roof.

An additional object is to provide a plastic roofing fastener of relatively low moisture content which is self-drilling to create a tapped hole in a concrete substrate and which absorbs water from the concrete substrate to expand into the tapped hole to increase the holding power of the roofing fastener.

BEST MODE FOR CARRYING OUT THE INVENTION

Figure 1:
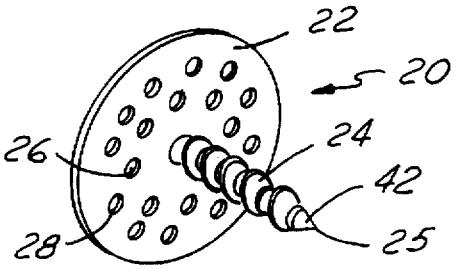
FIG. 1 is a perspective view of the underside of a roofing fastener made in accordance with the present invention.

FIG. 1 shows a roofing fastener 20 made in accordance with the present invention. Roofing fastener 20 comprises a disk shaped head 22 and an integral threaded shank 24. Preferably, roofing fastener 20 is made of either zinc or a nylon reinforced plastic. If made of plastic, ideally the plastic is dried prior to its injection molding to remove moisture therefrom so that the resulting fastener has a low moisture content.

The diameter of the head 22 is on the order of 1½ to 2 times the length of the shank 24. In a preferred form, the shank measured from the underside of the head to the tip 25 is 1.700 inches and the head diameter is 3.000 inches. The thread of the shank has a pitch diameter which is at least twice the root diameter.

Figure 4:
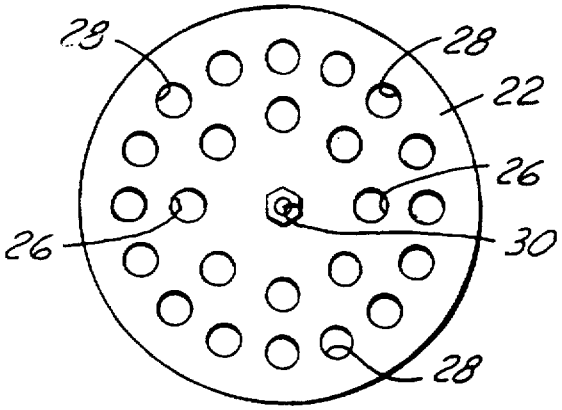
FIG. 4 is a top plan view of the roofing fastener of FIG. 1.

Referring now to FIG. 4, head 22 has inner and outer rings of openings 26 and 28, respectively. In this preferred exemplary embodiment, head 22 has a diameter of three inches. There are eight inner openings 26 and sixteen outer openings 28. Each of openings 26 and 28 ideally have a diameter of 0.250 inches and are evenly circumferentially spaced. Other numbers and arrangements of openings could be utilized as well as opening sizes and shapes.

Figure 6:
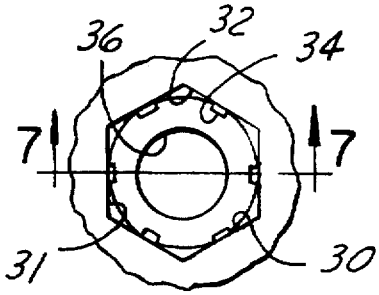
FIG. 6 is an enlarged fragmentary view taken from the encircled area 6 of FIG. 4.

Referring now to FIG. 6, at the center of head 22 and extending coaxially into shank 24, is an opening 30 including a hexagonal socket 31 including six flats 32. In the center of each of flats 32 is a small nubbin 34 which extends radially inwardly. Nubbins 34 are adapted to receive a hexagonal drill bit in a press fit condition when the drill bit is inserted into socket 31. Accordingly, this press fit condition allows roofing fastener 20 to be suspended from the drill bit without falling off thereof. Nubbins 34 are also shown in FIG. 7.

Figure 5:
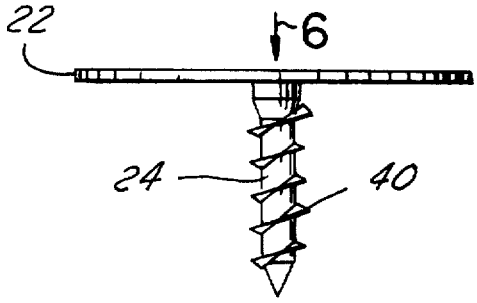
FIG. 5 is a side elevational view of the roofing fastener.
Figure 7:
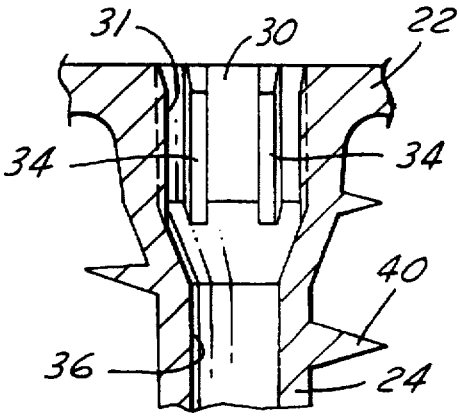
FIG. 7 is an enlarged fragmentary view taker along 7—7 of FIG. 6 showing an internal socket of the roofing fastener.

Referring to FIG. 7, a smooth bore 36 connects with socket 31 and extends down the length of the shank 24 but stops short of the lower end or tip 25 thereof. On the outside of shank 24 is formed an internal spiral thread 40. As seen in FIG. 5, the terminal end or tip 25 of shank 24 includes cutting blade 42.

Figure 2:
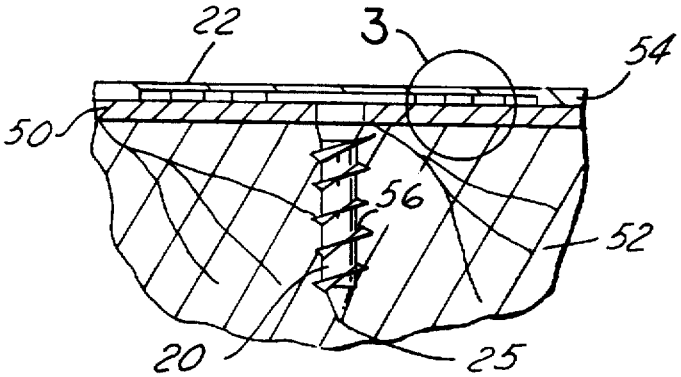
FIG. 2 is a sectional view showing a sheet of base ply being retained by the roofing fastener of FIG. 1 with the base ply having an overlying layer of asphalt.
Figure 3:
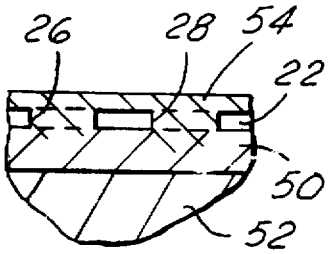
FIG. 3 is an enlarged fragmentary view taken from the encircled area of FIG. 2 showing asphalt passing through apertures in the head of the roofing fastener which assists in retaining the roofing fastener to the base ply.

FIG. 2 shows roofing fastener 20 retaining a base ply 50 to a roofing substrate, such as a lightweight concrete deck 52. Overlying head 22 of roofing fastener 20 and base ply 50, is an asphalt layer 54. As best seen in FIG. 3, the asphalt poured over head 22 passes through inner and outer openings 26 and 28 to contact the base ply therebeneath and help capture or trap roofing fastener 20 between asphalt layer 54 and concrete deck 52. Roofing fastener 20 is self-drilling and creates a helical cavity 56 in the deck.

In operation, a drill with a hexagonal drill bit (not shown) thereon is used to install roofing fasteners 20 through sheets of base ply 50 and into concrete deck 52. The hexagonal drill bit is forced into socket 31 with the radially inwardly extending nubbins 34 grasping about the drill bit in a press fit condition. Thus, roofing fastener 20 can be suspended from the drill bit without roofing fastener 20 falling from the drill and drill bit.

Cutting blade 42 of shank 24 is pressed into contact with base ply 50. The drill is then operated to rotate roofing fastener 20 with cutting blade 42 first cutting a hole through base ply 50 and then initiating a blind hole in concrete deck 52. As the drill bit and roofing fastener 20 are rotated, the blind hole created by cutting blade 42 is further enlarged by thread 40 creating helical cavity 56.

Roofing fastener 20 is continued to be threaded into concrete deck 52 until head 22 bears upon base ply 50. This operation of fastening a base ply 50 to concrete deck 52 by threading roofing fasteners 20 into a number of sheets of base ply 50 and concrete deck 52 is continued until the sheets of base ply 50 are securely fastened to concrete deck 52 thereby extending over and covering all of concrete deck 52.

Next, molten asphalt is poured over the sheets of base ply 50 creating asphalt layer 54. A portion of the molten asphalt passes through inner openings 26 and outer openings 28 to further enhance the ability of roofing fastener 20 to hold down base ply 50 and asphalt layer 54. In some instances, it may be desirable to lay down a second layer of base ply 52 and then another overlying layer of asphalt.

If the concrete deck 52 contains any significant quantity of water, the roofing fastener 20, if composed of low moisture content molded plastic, will absorb water from concrete deck 52. This water absorbed by the roofing fastener 20 causes shank 24 with threads 40 thereon to swell within helical cavity 56. This swelling enhances the pull-out strength of roofing fastener 20 relative to concrete deck 52.

Comparative tests of this improved fastener and three commercially available competitive fasteners were performed. The competitive fasteners are manufactured by Buildex, Olympic and ES Products. All three parts are of the same general design and are fabricated from folded steel. Some are galvanized or coated with an organic anti-corrosive coating. There is little or no difference in the performance of the three parts after 28 days. There is a minor increase in performance of the galvanized parts when left for greater than 90 days.

The following is a summary of the data compiled from 21 samples or greater of each part. The test procedure for all samples is identical. The test procedure established in the Test Protocol PA 105, published by Metro-Dade County, was utilized for all tests. The testing apparatus is a Satec Tensile tester calibrated by the manufacturer with a testing certificate which can be traced back to the National Institute of Standards and Testing (NIST).

The parts were tested in two types of lightweight material, aggregate and cellular. The two materials vary in structure and water content. The following summary is from data gathered in a one month period. In the following chart, the fastener which is the subject of this application is identified as BASE-LOK.

| Material | Base-Lok Average | Olympic Average | ES Products Average | Buildex Average |
|---|---|---|---|---|
| 200 psi Cellular | 167 lbf | 119 lbf | 116 lbf | 118 lbf |
| 200 psi Aggregate | 161 lbf | 97 lbf | 104 lbf | 109 lbf |
| 300 psi Cellular | 186 lbf | 131 lbf | 136 lbf | 122 lbf |

The standard deviation of the BASE-LOK parts recorded significantly lower values than the competitive parts. The samples of the BASE-LOK fasteners were grouped closer than all of the competitive parts. It will be noted that the fastener disclosed in this application required significantly higher forces to dislodge applicant's fastener than the other three tested.

While in the foregoing specification this invention has been described in relation to a certain preferred embodiment thereof, and many details have been set forth for the purpose of illustration, it will be apparent to those skilled in the art that the invention is susceptible to alteration and that certain other details described herein can vary considerably without departing from the basic principles of the invention.

What is claimed is:

1. A method for retaining roofing materials to a roof, the method comprising:

placing a base ply over a roof substrate;

self-threading an integral roofing fastener having a planar head with openings therein and a threaded shank through the base ply and into the roof substrate;

continuing such self-threading until said planar head bears against the base ply; and applying a layer of molten asphalt over the base ply and roofing fastener with asphalt passing through openings in the head and contacting the base ply therebeneath to envelope the head in the asphalt and bond the head to the base ply.

2. The method of claim 1 wherein:

the roofing fastener is made of plastic.

3. The method of claim 2 wherein:

the plastic is of low moisture content.

4. The method of claim 3 further comprising:

absorbing water from the roof substrate into the low moisture plastic of the roofing fastener with the threaded shank swelling to increase the holding power of the roofing fastener within the roof substrate.

5. The method of claim 1 wherein:

the head has a larger diameter than the length of the shank with the head providing a large shear area against tear out of the base ply relative to the roof fastener.

6. The method of claim 1 wherein:

the roof substrate is a concrete deck.

7. A roofing assembly comprising:

a roof substrate;

a base ply overlying the roof substrate;

a plurality of roofing fasteners, at least one of the roofing fasteners having an integral head and a shank with threads thereon, the head overlying the base ply and bearing thereon, and the threads in threaded engagement with the roof substrate; and a layer of asphalt overlying the head of the roofing fastener and the base ply;

wherein the threaded engagement between the threads of the shank of the roofing fastener and the roof substrate and the bearing of the head upon the base ply retain the base ply to the roof substrate.

8. The roofing assembly of claim 7 wherein:

the head is generally round and has a diameter which is greater than the length of the shank.

9. The roofing assembly of claim 7 wherein:

the head has a plurality of openings therein with asphalt passing through the openings to sandwich the head between the base ply and the asphalt.

10. The roofing assembly of claim 7 wherein:

the ratio of the pitch diameter of the thread to the diameter of the shank is greater than 2 to 1.

11. The roofing assembly of claim 7 wherein:

the shank has a leading cutting edge thereon which allows the roof fastener to be self-drilled into the roof substrate.

12. The roofing assembly of claim 7 wherein:

the roofing fastener includes a socket with radially inwardly projecting nubbins whereby a drill bit placed within the socket with the nubbins creates a press fit between the socket and a drill bit to allow the roofing fastener to be suspended from the drill bit.

13. The roofing assembly of claim 7 wherein:

the roof substrate has at least one helical cavity and the roofing fastener is swelled with moisture thereby creating a press-fit between the threaded shank and the helical cavity of the roof substrate.

14. A one piece roofing fastener for retaining a base ply to a roof substrate, the roofing fastener comprising, in combination:

a head integrally secured to a shank for movement therewith;

the head having a diameter of between one-and-one-half to twice the length of the shank;

a plurality of openings extending through the head and arranged in concentric rows; and said shank having a helical thread thereon and a distal end with a knife edge capable of initiating a hole in a concrete deck.

15. The roofing fastener of claim 14 wherein:

said thread having a root diameter and a pitch diameter which is at least twice as large as the root diameter.

16. The roofing fastener of claim 14 wherein:

the roofing fastener includes a socket which extends into the shank, the socket including a polygonal shape for receiving a drill bit.

17. The roofing fastener of claim 16 wherein:

the socket has flats and a plurality of radially inwardly extending nubbins which are adapted to receive a polygonal shaped drill bit in a press fit condition while allowing flats of the socket to cooperate with the drill bit so that the roofing fastener can be rotated with the drill bit.

18. The roofing fastener of claim 14 wherein:

the shank includes a closed bore therein in communication with the socket.

19. The roofing fastener of claim 14 wherein:

the fastener is made of a low moisture plastic capable of absorbing moisture from the surrounding roof substrate.

20. A roofing fastener for retaining a base ply to a roof substrate, the roofing fastener comprising, in combination:

a head integrally secured to the shank;

said head having a plurality of openings therethrough and the shank having a helical thread thereon and a distal end with a knife edge capable of initiating a hole in the roof substrate;

said shank shaped to provide a socket including a polygonal shape for receiving a drill bit; and said socket having flats and a plurality of inwardly extending nubbins adapted to receive a polygonal shaped drill bit in a press fit while allowing said flats to cooperate with the drill bit to rotatably drive the fastener upon rotation of the drill bit.

* * * * *